United States Patent [19]

Ohashi et al.

[11] 4,424,939

[45] Jan. 10, 1984

[54] APPARATUS FOR WINDING WIRE AROUND TOROIDAL CORE

[75] Inventors: Toshijiro Ohashi; Yasuhiro Yamaguchi; Michinaga Kohno, all of Yokohama; Nobu Kamita, Hitachi, all of Japan

[73] Assignee: Hitachi, Ltd., Tokyo, Japan

[21] Appl. No.: 256,620

[22] Filed: Apr. 22, 1981

[30] Foreign Application Priority Data

Apr. 22, 1980 [JP] Japan ..... 55-52266

[51] Int. Cl.[3] ..... H01F 41/08

[52] U.S. Cl. ..... 242/4 R; 29/605; 242/7.03

[58] Field of Search ..... 242/4 R, 7.03; 29/605

[56] References Cited

U.S. PATENT DOCUMENTS

| | | | |
|---|---|---|---|
| 2,891,735 | 6/1959 | Muller | 242/4 R |
| 2,962,235 | 11/1960 | Ridler et al. | 242/4 R |
| 3,128,955 | 4/1964 | Stutz | 242/4 R |
| 3,967,786 | 7/1976 | Ivanov | 242/4 R |

FOREIGN PATENT DOCUMENTS

| | | | |
|---|---|---|---|
| 67510 | 6/1969 | German Democratic Rep. | 242/4 R |
| 857050 | 12/1960 | United Kingdom | 242/4 R |
| 141220 | 12/1961 | U.S.S.R. | 242/4 R |

OTHER PUBLICATIONS

Pneumatic Core Winding Apparatus, IBM Technical Disclosure Bulletin, vol. 10, No. 7, Dec. 1967, pp. 950, 951.

*Primary Examiner*—Billy S. Taylor

*Attorney, Agent, or Firm*—Antonelli, Terry & Wands

[57] ABSTRACT

A method of and an apparatus for winding a wire around a toroidal core wherein one end portion of the wire is fixed in a predetermined position and the other end portion thereof is gripped, while leaving free a predetermined length from the leading end, by a gripping device which is moved to a position suitable for bringing the leading end substantially into alignment with a center opening formed in the toroidal core in the side of one surface thereof. After releasing the wire from the gripping device, the leading end of the wire passing through the opening and extending beyond the other surface of the toroidal core is gripped by a pull-out device which is moved to partially pull the wire out of the opening axially thereof, and the other end portion of the wire is again gripped by the gripping device while releasing the wire from the pull-out device. The gripping device is moved to the position to which it moved previously while tensioning the portion of the wire pulled out of the opening, whereby the wire can be fully pulled out of the opening and wound around the toroidal core.

12 Claims, 31 Drawing Figures

APPARATUS FOR WINDING WIRE AROUND TOROIDAL CORE

BACKGROUND OF THE INVENTION

This invention relates to methods of and apparatus for winding a wire around a toroidal core, and more particularly it is concerned with a method of and an apparatus for forming a coil suitable for winding a wire around a very small toroidal core used with a magnetic head of a computer or videotape recorder.

An apparatus disclosed in U.S. Pat. No. 4,184,644 is known for producing a coil on a toroidal core. This coil winding apparatus includes a traveling ring and a shuttle arranged in a right-angle relation to the toroidal core, the shuttle having a wire of a predetermined length wound thereon and the toroidal core having one end of the wire secured thereto, the traveling ring and the shuttle being rotated to thereby wind the wire around the toroidal core to form a coil.

This apparatus has the disadvantage that it can not be utilized with toroidal cores of the type that are too small for the traveling ring and the shuttle to be introduced into the inner region of the toroidal core.

As an apparatus for mechanically winding a wire around a toroidal core which is too small for a coil thereon by using a traveling ring and a shuttle, a winding apparatus as disclosed in Japanese Patent Publication No. 3171/63 is known which effects winding of a wire around a toroidal core by manipulating a needle connected to one end of a wire to be wound around the toroidal core.

More specifically, the winding apparatus comprises a chuck for gripping the needle connected to one end of the wire, a hammer located above the toroidal core held in the winding position by support means, a support table, interposed between the toroidal core and the hammer, formed with an opening for the needle to extend therethrough and a groove for the wire to be pulled therethrough, and a pair of rollers located below the toroidal core for rotational and sliding movements.

The wire of a predetermined length is passed through the eye of the needle at one end thereof and connected thereto, and then the other end of the wire is secured to the toroidal core. Thereafter the needle is gripped by the chuck which is positioned above the opening formed in the support table. The hammer is moved downwardly to press the needle gripped by the chuck downwardly, to let the forward end of the needle extend through the opening of the support table and the toroidal core and emerge from the toroidal core at its lower portion. Simultaneously as the chuck is opened to release the needle, the chuck is moved to a position below the toroidal core to grip the needle again. Then the needle is moved downwardly and withdrawn from the toroidal core, and moved to a position below the rollers. As the needle passes between the pair of rollers, the rollers rotate while being brought into engagement with each other to hold the wire therebetween, to thereby withdraw the wire from the toroidal core. At this time, the wire clears the groove of the support table to be wound around the toroidal core. Meanwhile, the chuck moves the needle to a position between the support table and the hammer in which the forward end of the needle is positioned against the opening of the support table. Upon completion of withdrawing of the wire, the rollers are brought out of engagement with each other, to release the wire.

By repeating the process described hereinabove, the wire of a predetermined length can be wound around the toroidal core to form a coil.

In the coil winding apparatus described hereinabove, difficulties are experienced in winding a wire around a toroidal core of the small size, such as the one used in a magnetic head of a computer or viedo tape recorder, in which a wire of 0.03 mm in diameter is wound around two widthwise separated sections of a toroidal core of a length of 3 mm, a width of 2.3 mm and a thickness of 0.15 mm formed in its central portion with an opening of a length of 0.45 mm and a width of 0.3 mm.

When a wire is wound around the toroidal core of the aforesaid dimensions, the opening of the toroidal core would have a width of about 0.1–0.15 mm due to the presence in the opening of the wire and to a bulge caused by the rigidity of the wire upon completion of winding. Meanwhile the needle of the winding apparatus is required to have a diameter of at least 0.2–0.3 mm when the strength of the needle and other factors are taken into consideration, and preferably the diameter is over 0.5 mm. Thus unless the opening of the toroidal core has a dimension of over 0.3 mm when the wire is wound thereon, the coil already produced on the toroidal core or the edge of the opening of the toroidal core would be damaged by the needle and the wire introduced into the opening by the needle.

The finer the wire, the lower is its rigidity. The wire of reduced rigidity might be bent between the underside of the toroidal core and the eye of the needle, so that the wire might catch against the support table and be rounded to produce a kink. When this phenomenon occurs, further continuation of the winding operation would become impossible.

In view of the status of the art of winding a wire around a toroidal core that prevails nowadays as described hereinabove, highly skilled techniques of the workers are relied on in manually winding a wire around a very small toroidal core, with very low operation efficiency.

SUMMARY OF THE INVENTION

An object of the present invention is to provide a method of and an apparatus for winding a wire around a toroidal core that is capable of automatically winding the wire around a toroidal core of small size.

Another object is to provide a method of and an apparatus for winding a wire aound a torodial core permitting the wire to pass through the opening formed in the toroidal core without damaging the coil already formed on the toroidal core.

Still another object is to provide a method of and an apparatus for winding a wire around a toroidal core capable of correctly bringing the center position of the torodial core opening in alignment with the leading end of the wire to be passed through the opening, to thereby allow the wire to positively pass through the toroidal core opening.

Still another object is to provide a method of and an apparatus for winding a wire around a toroidal core capable of preventing the occurrence of a kink in the wire that might otherwise be caused by bending or rounding of the wire.

Still another object is to provide a method of and an apparatus for winding a wire around a toroidal core capable of positively preventing the occurrence of a kink in the wire and damage to the wire as by the edge of the toroidal core opening that might otherwise take place as the wire is passed through the toroidal core opening, by guiding the wire prior to introduction into the toroidal core opening.

Still another object is to provide a method of and an apparatus for winding a wire around a toroidal core capable of positively preventing the occurrence of damage to the wire that might otherwise be caused to the wire by the edge of the opening as the wire is passed through the toroidal core opening, by guiding the wire that has been passed through and pulled out of the toroidal core opening.

A further object is to provide a method of and an apparatus for winding a wire around a toroidal core capable of winding the wire in regular order around the toroidal core.

DESCRIPTION OF THE PREFERRED EMBODIMENTS

Figure 1:
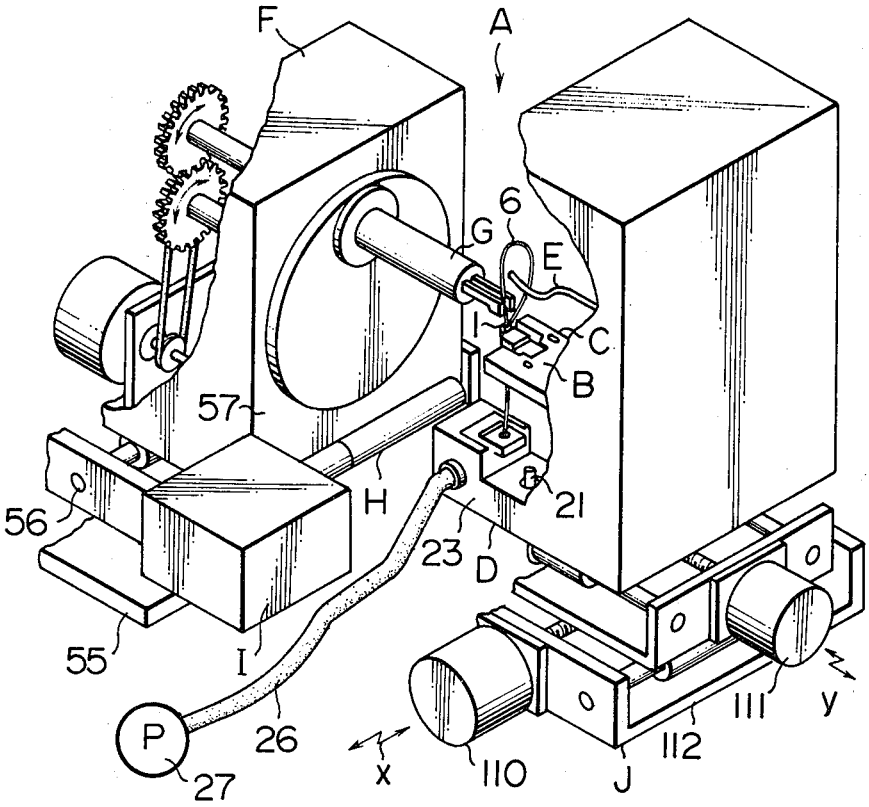
FIG. 1 is a perspective view of the coil winding apparatus comprising one embodiment of the invention.
Figure 2:
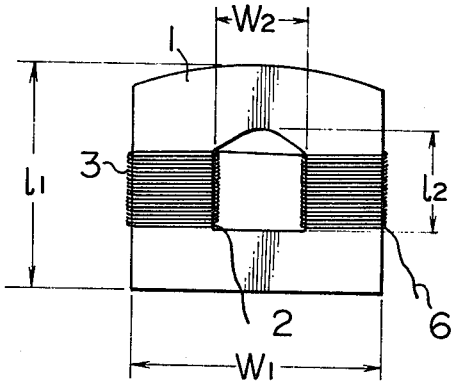
FIG. 2 is a front view of a toroidal core handled by the apparatus shown in FIG. 1.
Figure 3:
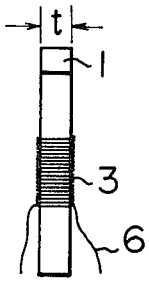
FIG. 3 is a side view of the toroidal core shown in FIG. 2.

A coil winding apparatus comprising one preferred embodiment of the invention is generally designated by the symbol A in FIG. 1. The coil winding apparatus A is suitable for producing magnetic heads each comprising a toroidal core 1 formed with an opening 2, and coils 3 wound thereon, as shown in FIGS. 2 and 3. As described in the Background of the Invention, the toroidal core 1 has, for example, a width $W_1$ of 2.3 mm, a length $l_1$ of3 mm and a thickness t of 0.15 mm, with the opening 2 having a width $W_2$ of 0.3 mm and a length $l_2$ of 0.45 mm. A wire 6 from which the coils 3 are wound has a diameter of 0.03 mm, for example.

Coil Winding Apparatus A

Referring to FIG. 1 again, the coil winding apparatus A comprises support means B for supporting the toroidal core 1 with the axis of the core opening 2 being disposed perpendicular to the horizontal, fixing means C for fixing one end portion of the wire 6, pull-out means D for gripping the other end portion of the wire 6 inserted in the core opening 2 from one surface or upper surface of the toroidal core 1 supported by the support means B to the other surface or under surface thereof and pulling the wire 6 out of the core opening 2, tensioning means E for applying tension to the wire 6 being wound around the core 1, transfer means F located in spaced juxtaposed relation to the support means B, fixing means C, pull-out means D and tensioning means E for transferring a leading end 7 of the other end portion of the wire 6 in a predetermined path, and a gripper G mounted on the transfer means F for gripping the other end portion of the wire 6.

Preferably, the coil winding apparatus A further comprises position sensing means H for sensing the center position of the core opening 2 and the position of the leading end 7 of the wire 6, a position correcting circuit I processing position information sensed by the position sensing means H and issuing a command to correct the relative displacement of the position of the leading end 7 of the wire 6 and the center position of the core opening 2, and a table J for moving the toroidal core 1 and the other end portion of the wire 6 relative to each other upon receipt of the command for correction issued by the position correcting circuit I, to bring the leading end of the wire 1 into alignment with the core opening 2.

Support Means B

Figure 5:
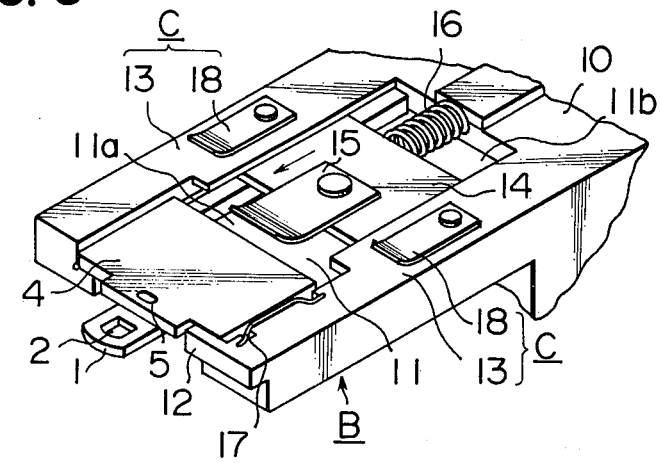
FIG. 5 is a perspective view, on an enlarged scale, of the toroidal core support means and the wire fixing means of the apparatus shown in FIG. 1.

Referring to FIG. 5, the support means B comprises a groove 11 formed in a base plate 10 and including a first portion 11*a* for receiving a core base 4 therein and a second portion 11*b* for receiving a slider 14 therein, a stopper 12 formed at the open end of the first portion 11*a* of the groove 11, the slider 14 slidably fitted in the second portion 11*b* of the groove 11, a plate spring 15 mounted on the slider 14 for holding down the core base 4, a compression spring 16 urging, by its biasing force, the slider 14 to move toward the stopper 12, and a plate spring 17 mounted on the base plate 10 near the first portion 11*a* of the groove 11 for pressing the core base 4 against one side of the first portion 11*a* of the groove 11.

Figure 4:
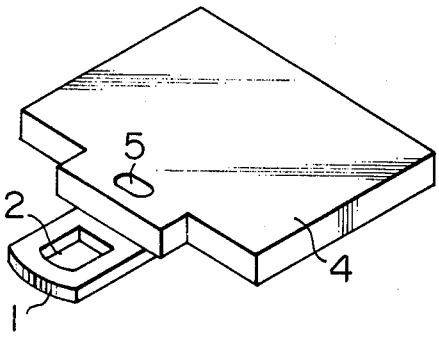
FIG. 4 is a perspective view showing the manner in which a toroidal core is attached to the core base.

The support means B of the aforesaid construction has fitted in the first portion 11*a* of the groove 11 the core base 4 having the toroidal core 1 mounted thereon beforehand as shown in FIG. 4. The core base 4 is restrained by the stopper 12 and slider 14 against movement in one direction and by the side wall of the first portion 11*a* of the groove 11 and plate spring 17 against movement in the other direction while being restrained against upward movement by the plate spring 15 mounted on the slider 14, so that the core plate 4 is fixed to the base plate 10 to hold in position the toroidal core 1 mounted on the core base 4.

In FIGS. 4 and 5, the numeral 5 designates a through hole formed in the base plate 4 for inserting one end portion of the wire 6 therein.

Fixing Means C

As shown in FIG. 5, the fixing means C comprises fixed arms 13, each disposed on one of opposite sides of the groove 11, and plate springs 18 each mounted on one of the fixed arms 13. The fixing means C is operative to hold, between the fixed arms 13 and plate springs 18, one end portion of the wire 6 that is pulled out of the through hole 5 formed in the core base 4 supported by the support means B, to fix the one end of the wire 6 in position.

Pull-Out Means D

Figure 6:
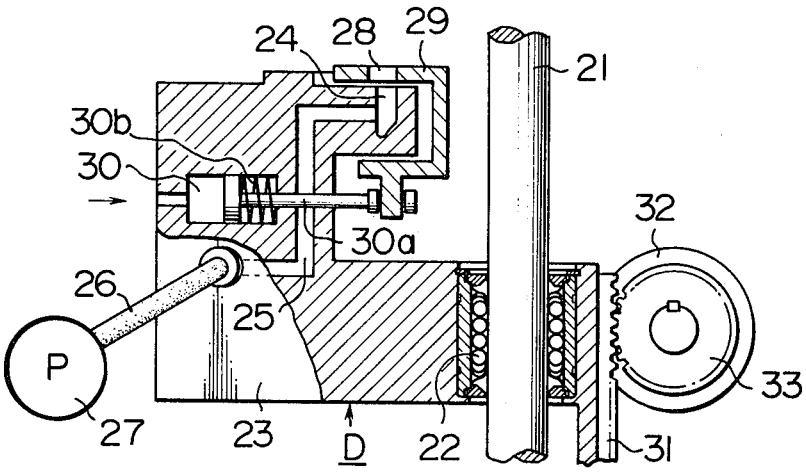
FIG. 6 is a side view, on an enlarged scale with certain parts being shown in section, of the pullout means of the apparatus shown in FIG. 1.

As shown in FIGS. 1 and 6, the pull-out means D comprises a guide rod 21 standing vertically, a nozzle body 23 supported by sliding movement by the guide rod 21 through a ball bush 22, a nozzle 24 formed in the nozzle body 23 and opening against the center position O of the core opening 2, an air drawing passage 25 connected to the nozzle 24 for drawing air, a vacuum pump 27 connected to the air drawing passage 25 via a tube 26, a support plate 29 formed with an opening 28 capable of communicating with the nozzle 24 mounted on the nozzle body 23 for sliding movement in a direction traversing the nozzle 24, a fluidic cylinder 30 for operating the support plate 29, a piston rod 30*a* inserted in the fluidic cylinder 30 and connected to the support plate 29, a compression spring 30*b* urging the piston rod 30*a* to return to its original position by its biasing force, a rack 31 for transferring the nozzle body 23, a stepping motor 32 and a pinion 33 mounted on the rotary shaft of the stepping motor 32 and in meshing engagement with the rack 31.

The pull-out means D of the aforesaid construction operates such that by rotating the stepping motor 32 in the normal direction, when the nozzle body 23 is in a retracted position, the nozzle body 23 can be moved by the operation of the rack 31 and pinion 33 toward the toroidal core 1 supported by the support means B. As the nozzle body 23 moves to a predetermined position in which the support plate 29 is located close to the other surface of the core opening 2, the fluidic cylinder 30 is actuated to operate the support plate 29 to bring the opening 28 thereof into alignment with the nozzle 24. At the same time, the vacuum pump 27 is actuated to evacuate the opening 28, nozzle 24 and air drawing passage 25, to thereby draw, by suction into the opening 28 and nozzle 24, the leading end 7 of the wire inserted in the core opening 2 and extending therethrough to the other surface of the core opening 2. Simultaneously, as the leading end 7 of the wire 6 is drawn by suction, the support plate 29 is moved by the action of the piston rod returning compression spring 30*b*, to displace the opening 28 of the support plate 29 and the nozzle 24 relative to each other and support the leading end 7 of the wire 6 between the side of the nozzle 24 and the side of the opening 28 of the support plate 29. Simultaneously, as the leading end 7 of the wire 6 is held in position as aforesaid, the vacuum motor 27 is de-actuated and the stepping motor 32 is rotated in the reverse direction, to move the nozzle body 23 by the operation of the rack 31 and pinion 33 in a direction away from the toroidal core 1 and pull the wire 6 out of the core opening 2. Thereafter, as soon as the wire 6 pulled out as aforesaid is gripped by a claw 93 (see FIG. 7) of the gripper G, the fluidic cylinder 30 is actuated to move the support plate 29 in a direction in which the opening 28 thereof is aligned with the nozzle 24. The wire 6 is released and handed over to the gripper G.

When it is possible to cause the leading end 7 of the wire 6 to be positively inserted in the nozzle 24 and opening 28 merely by moving to access the pull-out means D toward the under surface of the toroidal core 1, the vacuum sunctioning means 25, 26 and 27 may be dispensed with.

Tensioning Means E

Figure 7:
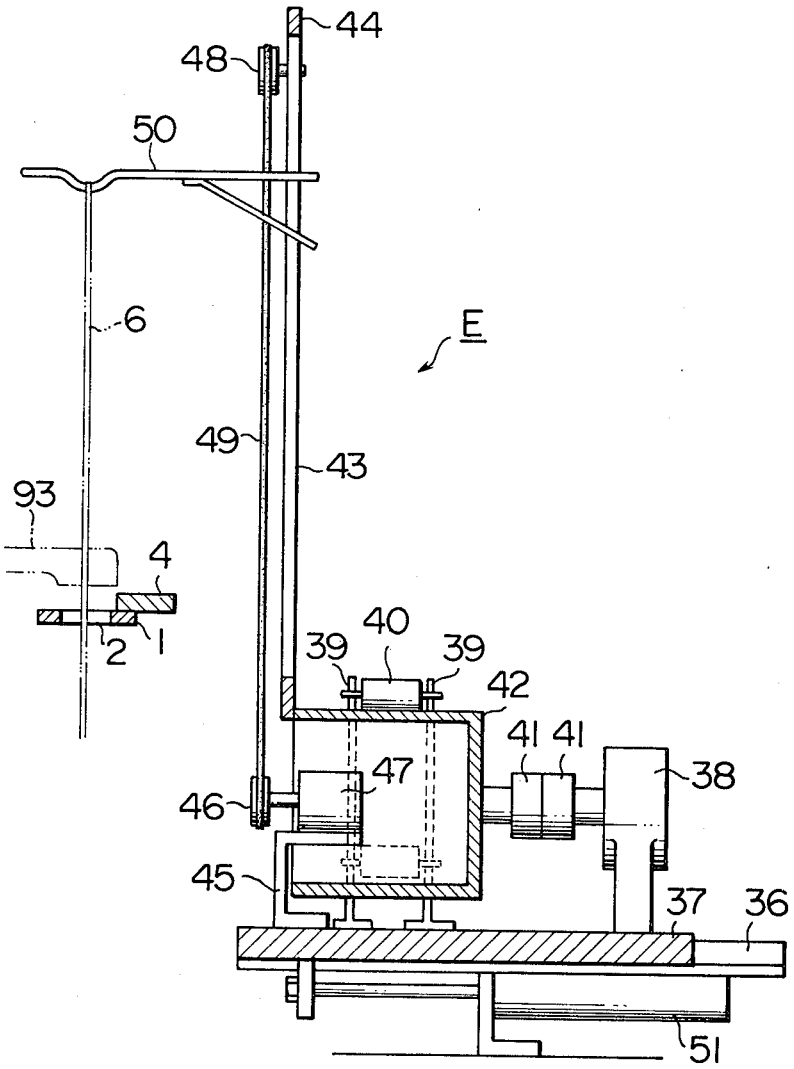
FIG. 7 is a side view, on an enlarged scale with certain parts being shown in section, of the tensioning means of the apparatus shown in FIG. 1.

Referring to FIG. 7, the tensioning means E comprises a movable plate 37 supported for sliding movement by a pair of rails 36, a stepping motor 38 supported on the movable plate 37, at least three of a plurality of rollers 40 arranged circumferentially of a bracket 39 supported on the movable plate 37 and supported thereby for rotation, a drum 42 connected to the stepping motor 38 through a coupling 41 and supported for rotation between the rollers 40, a guide plate 44 formed with a slot 43 secured to the drum 42, a servomotor 47 arranged in the drum 42 with its axis being disposed on the axis of the drum 42 and mounted on a support 45 secured to the movable plate 37, a pulley 46 supported by the rotary shaft of the servomotor 47, a pulley 48 supported at the end of the guide plate 44, a belt 49 trained over the pulleys 46 and 48, a tensioning rod 50 mounted on the belt 49 and havng one end portion thereof inserted in the slot 43 of the guide plate 44 to have its posture regulated by the slot 43 and a fluidic cylinder 51 for operating the movable plate 37.

The tensioning means E of the aforesaid construction operates such that as the servomotor 47 is rotated in the normal direction, the belt 49 travels in the normal direction with rotation of the pulleys 46 and 48, and the tensioning rod 50 moves through the slot 43 of the guide plate 44 in one direction in which the wire 6 trained over the tensioning rod 50 is tensioned. Conversely, rotation of the servomotor 47 in the reverse direction slackens the wire 6. Rotation of the stepping motor 38 causes the drum 42 to rotate and swing the guide plate 44, so that the tensioning rod 50 is made to swing around the toroidal core 1 about the axis of the drum 42. With the axis of the pulley 46 being aligned with the axis of the drum 42 during the swinging movement of the tensioning rod 50, the belt 49 is prevented from being loosened and, consequently, the tensioning rod 50 remains in the same position with respect to the length of the slot 43 of the guide plate 44. By actuating the fluidic cylinder 51 in one direction or the other direction, the movable plate 37 can be moved along the rails 36, to thereby move the tensioning rod 50 forwardly or rearwardly with respect to the predetermined path of travel of the wire 6.

Transfer Means F

Figure 8:
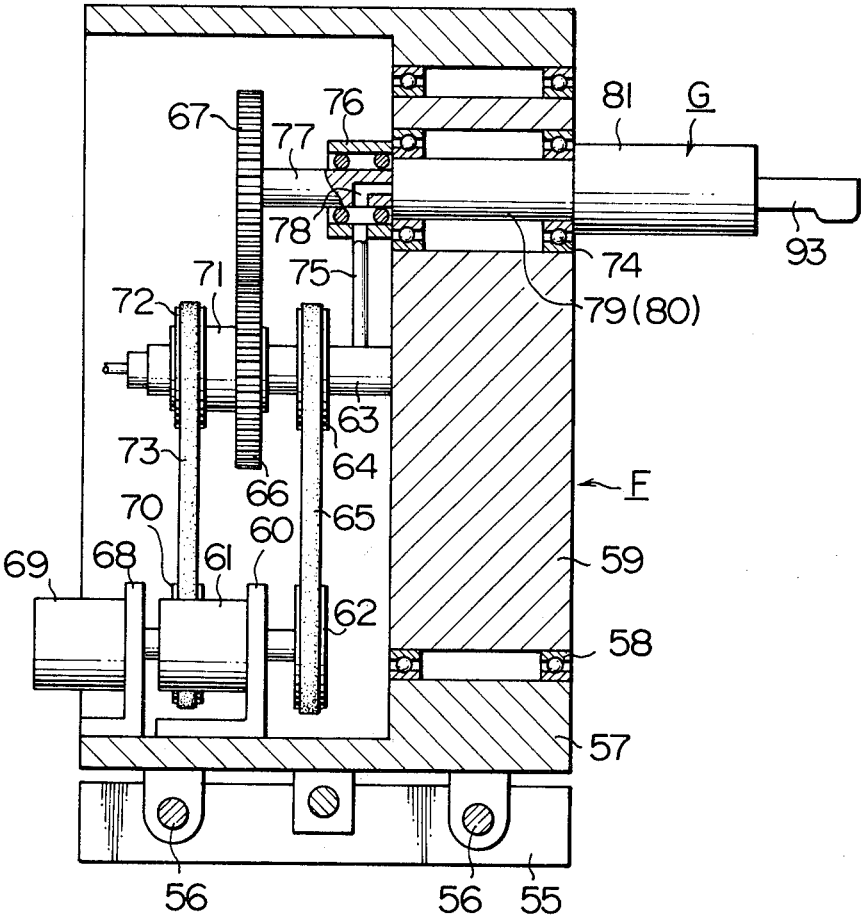
FIG. 8 is a side view, on an enlarged scale with certain parts being shown in section of the transfer means of the apparatus shown in FIG. 1.

FIG. 8 shows the transfer means F for the wire 6 comprising a pair of support metal members 55, a casing 57 slidably supported by guide bars 56 disposed parallel to each other and supported by the support metal members 55, a disc 59 rotatably supported by the casing 57 through a bearing 58, a stepping motor 61 supported on a support member 60 fixed to the casing 57, a pulley 62 mounted on the rotary shaft of the stepping motor 61, a pulley 64 mounted on a shaft 63 projecting from the central portion of one end surface of the disc 59, a belt 65 trained over the pulleys 62 and 64, an intermediate shaft 71 connected to the shaft 63, a stepping motor 69 supported on a support member 68 fixed to the casing 57, a pulley 70 mounted on the rotary shaft of the stepping motor 69, a pulley 72 supported by the intermediate shaft 71, a belt 73 trained over the pulleys 70 and 72, a gear 66 supported by the intermeidate shaft 71 and a gear 67 supported by a rotary shaft 77 of the gripper G and meshing with the gear 66. The gripper G is journaled by a bearing 74 mounted in the disc 59 in an off-center position for rotation. A pipe 75 for supplying compressed air for actuating the gripper G is connected between the shaft 63 projecting from the central portion of the disc 59 and a swivel joint 76 mounted around the rotary shaft 77.

The transfer means F of the aforesaid construction operates such that rotation of the stepping motor 61 causes the shaft 63 to rotate, and through the pulleys 62 and 64 and the belt 65, to rotate the disk 59, to thereby cause the gripper G to revolve around the shaft 63. This permits the other end portion of the wire 6 gripped by the claw 93 of the gripper G to be transferred along a predetermined path. As the gripper G revolves around the shaft 63, the gripper G also rotates on its own axis as it is rotated by the gears 66 and 67 meshing with each other. By rotating the stepping motor 69 in a direction opposite to the direction of rotation of the gripper G on its own axis when it is necessary to do so, the intermediate shaft 71 can be rotated through the pulleys 70 and 72 and the belt 73 and the rotary shaft 77 can be rotated through the gears 66 and 67 in a direction opposite to the direction in which the gripper G rotates on its own axis, so that the gripper G stops rotating on its own axis and only revolves around the shaft 63. In case the gripper G does not need to rotate on its own axis, the assembly of the stepping motor 69, pulleys 70 and 72 and belt 73, the assembly of the intermediate shaft 71, and gears 66 and 67, and the bearing 74 may be done without, and the gripper G may be directly secured to the disc 59.

Gripper G

Figure 9:
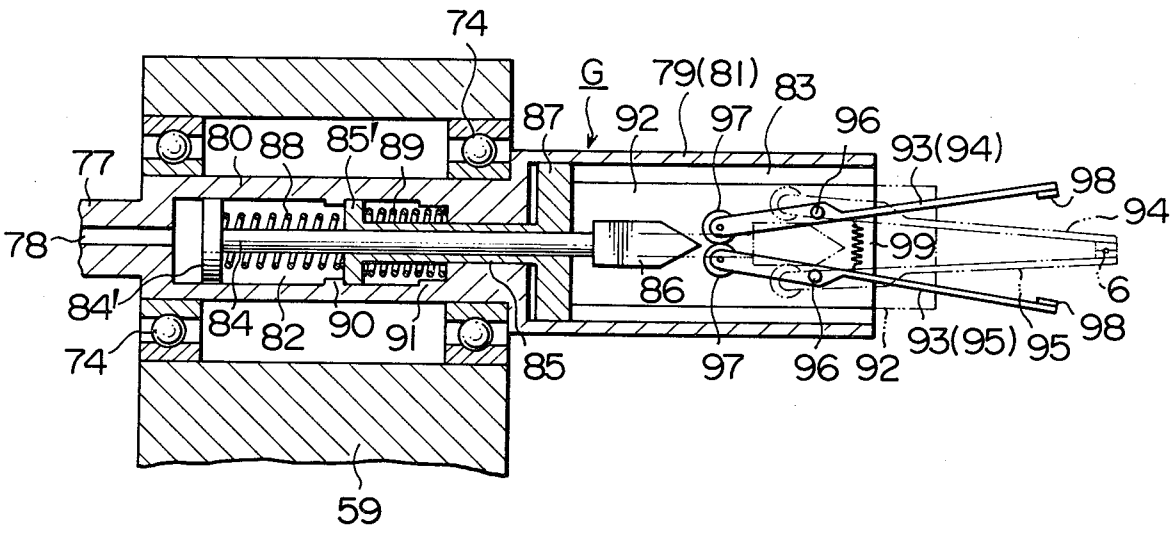
FIG. 9 is a vertical sectional side view , on a further enlarged scale, of the gripper of the transfer means shown in FIG. 8.

Referring to FIG. 9, the gripper G comprises a rotary shaft 77 formed with a compressed air introducing passage 78, a housing 79, including a first portion 80 continuous with the rotary shaft 77 and journaled by the bearings 74 in the off-center position in the disc 59 of the transfer means F and a second portion 81 connected to the forward end of the first portion 80, a first chamber 82 defined in the first portion 80 of the housing 79, a second chamber 83 defined in the second portion 81 of the housing 79, a first rod 84 having at its rearward end portion a plunger 84' located in the first chamber 82 and at its forward end portion a cam 86 located in the second chamber 83 and supported for sliding movement in the housing 79, a second rod 85 formed hollow and having at its rearward end portion a plunger 85' located in the first chamber 82 and at its forward end portion a bracket 87 located in the second chamber 83, the first rod 85 being fitted over the first rod 84 and slidably supported in the housing 79, a first compression spring 88 mounted at the rear and side of the first chamber 82 and urging the first rod 84, by its biasing force, to move in a rearward direction, a second compression spring 89 mounted at the forward end side of the first chamber 82 and urging the second rod 85 by its biasing force to move in a rearward direction, a first stopper 90 for the plunger 84' of the first rod 84, a second stopper 91 for the plunger 85' of the second rod 85, a support plate 92 mounted on the bracket 87 of the second rod 85 and located on the second chamber 83 side, and the claw 93 connected to the support plate 92. The claw 93 comprises a first member 94 and a second member 95 juxtaposed against each other, each of the first and second members 94 and 95 being supported at the intermediate portion by a pin 96, having a roller 97 at the rearward end and having a shock absorber 98 at the forward end, and a spring 99 urging by its biasing force the forward end portions of the two claw members 94 and 95 to move away from each other. The members 94 and 95 of the claw 93 are normally open.

When the wire 6 is gripped by the gripper G, compressed air is introduced through the introducing passage 78 in the rotary shaft 77 and presses the plunger 84' of the first rod 84 forwardly, to compress the first compression spring 88. The biasing force of the compression spring 88 presses the plunger 85' of the second rod 85 forwardly, so that the cam 86 of the first rod 84 and the bracket 87 of the second rod 85 moves forwardly to the forward end portion of the second chamber 83. As the plungers 84' and 85' of the first and second rods 84 and 85 move forwardly into abutting engagement with the first and second stoppers 90 and 91 respectively, the support plate 92 mounted on the bracket 87 moves forwardly to a position shown in phantom lines in FIG. 9, and the claw 93 is moved forwardly together with the support plate 92 to a position in which it can grip the wire 6. When the claw 93 is in this position, the cam 86 of the first rod 84 is inserted between the rollers 97 of the first and second members 94 and 95 respectively of the claw 93 and the first and second members 94 and 95 are pivotally moved about the pins 96 to a closed position, so that the wire 6 is gripped by the shock absorbing members 98 of the first and second members 94 and 95 as indicated by phantom lines in FIG. 9. As the leading end 7 of the wire 6 is inserted in the core opening 2 of the toroidal core 1 with the wire being gripped by the gripper G, the gripper G is moved along the guide bars 56 parallel thereto shown in FIG. 8. As the wire 6 is wound around the toroidal of the toroidal core 1, the gripper G is rotated around the shaft 63 by rotation of the disc 59 shown in FIG. 8, so that the wire 6 is transferred along a predetermined path. As the wire 6 is released by the gripper G, the pressure in the compressed air introducing passage 78 is reduced to an atmospheric pressure level, to allow the first rod 84 to be moved rearwardly by the biasing force of the first compression spring 88. This results in the cam 86 being withdrawn from between the rollers 97 of the first and second members 94 and 95 of the claw 93, so that the first and second members 94 and 95 are opened by the biasing force of the spring 99 of the claw 93 to release the shock absorbing members 98 from gripping engagement with the wire 6. Thereafter the first and second rods 84 and 85 are moved rearwardly by the biasing forces of the first and second compression springs 88 and 89 respectively, to allow the elements to return to their original positions shown in FIG. 9 in solid lines.

Position Sensing Means H

Figure 10:
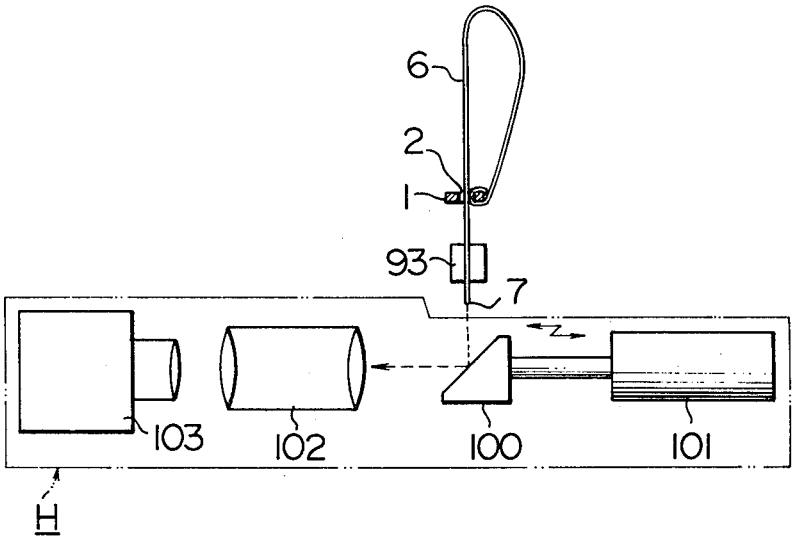
FIG. 10 is a side view, on an enlarged scale, of the position sensing means of the apparatus shown in FIG. 1.

As shown in FIG. 10, the position sensing means H is an optical system comprising a reflector 100 having the images of the core opening 2 of the toroidal core 1 and the leading end 7 of the wire 6 incident thereon, a fluidic cylinder 101 moving the reflector 100 from a position in which it does not interfere with the pull-out means D and the gripper G for the wire 6 to a position disposed immediately below the other surface or under surface of the core opening 2 of the toroidal core 1 located in a predetermined position, a microscope 102 enlarging the images incident on reflector 100 and a TV camera 103 converting the optical images enlarged by the microscope 102 into electric signals and transmitting the image information to the position correcting circuit I.

The position sensing means H operates in such a manner that, for sensing the positions of the core opening 2 and the leading end 7 of the wire 6, the fluidic cyclinder 101 is actuated to move the reflector 100 forwardly to a position immediately below the other surface of the core opening 2. Upon the images of the core opening 2 and the leading end of the wire 6 being incident on the reflector 100, they are reflected toward the microscope 102 which enlarges the images and transfers them to the TV camera 103, which converts the optical images to electric signals and transmits the image information to the position correcting circuit I. Following processing of the image information, the hydraulic cylinder 101 is actuated to move the reflector 100 rearwardly to the original position in which it does not interfere with the aforesaid elements.

Position Correcting Circuit I

Figure 11:
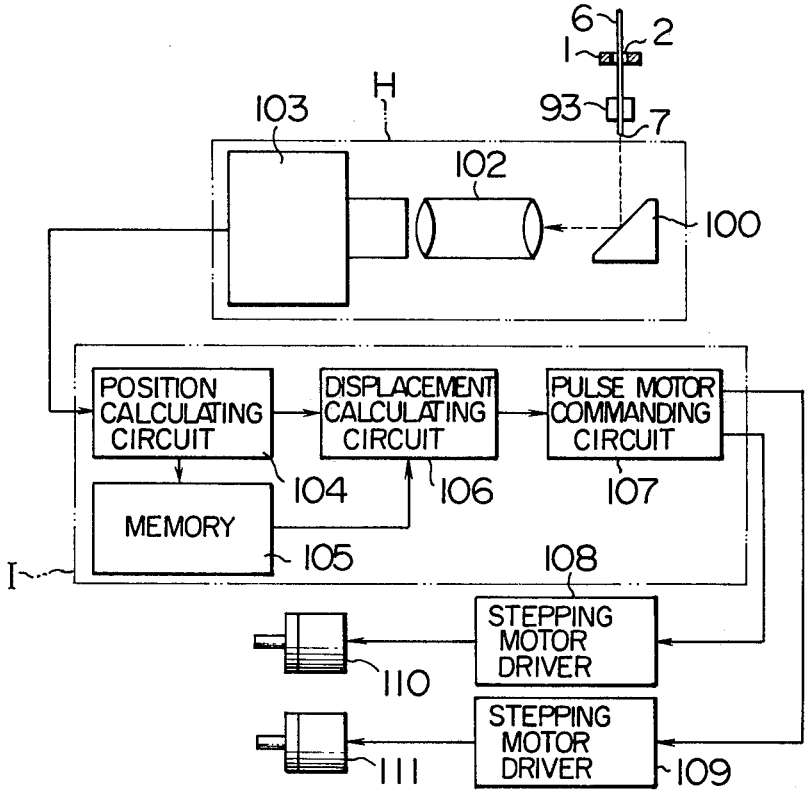
FIG. 11 is a diagram of the position correcting circuit of the apparatus shown in FIG. 1.

The position correcting circuit I is shown in FIG. 11 in a block diagram and comprises a position calculating circuit 104 connected to the TV camera 103 of the position sensing means H, a memory 105 connected to the position sensing circuit 104, a displacement calculating circuit 106 connected to the position calculating circuit 104 and the memory 105, and a stepping motor commanding circuit 107 connected to the displacement calculating circuit 106 for supplying command signals to first and second stepping motor drivers 108 and 109 respectively connected to first and second stepping motors 108 and 109 of the table J.

The position correcting circuit I operates such that the center position 0 of the core opening 2 is calculated at the position calculating circuit 104 based on the image information transmitted from the TV camera 103 and stored in the memory 105. The center position 0 of the core opening 2 and the position of the leading end 7 of the wire 6 are transmitted to the displacement calculating circuit 106 via the position calculating circuit 104 and the center position 0 of the core opening 2 stored in the memory 105 in the preceding stage is transmitted to the displacement calculating circuit 106 via the memory 105. The amount of displacement of the center position 0 of the core opening 2 with respect to the position of the leading end 7 of the wire 6 is calculated at the displacement calculating circuit 106 and supplied to the stepping motor commanding circuit 107 which supplies to the first and second stepping motor drivers 108 and 109 position correcting pulses commensurate with the amount of displacement calculated at the displacement calculating circuit 106.

Table J

The table J mounting thereon the support means B, fixing means C and pull-out means D comprises, as shown in FIGS. 1 and 11, the first and second stepping motor drivers 108 and 109 individually connected to the stepping motor commanding circuit 107 of the position correcting circuit I, first and second stepping motors 110 and 111 connected in series with the first and second stepping motor drivers 108 and 109 respectively, and a table body 112 moved in fine movement as by a ball-and-screw mechanism controlled by the first and second stepping motors 110 and 111.

As the first stepping motor 110 is driven through the first stepping motor driver 108 by the position correcting pulses supplied from the stepping motor commanding circuit 107, the table body 112 is moved in fine movement in the direction of an arrow x widthwise of the toroidal core 1. As the second stepping motor 111 is driven through the second stepping motor driver 109 by the position correcting pulses supplied from the stepping motor commanding circuit 107, the table body 112 is moved in fine movement in the direction of an arrow y lengthwise of the toroidal core 1. Thus as the table body 112 is moved in fine movement in the directions x and y, fine adjustments of the position of the toroidal core 1 supported by the support means B are effected with respect to the position of the leading end 7 of the wire 6 gripped by the gripper G, to thereby effect positioning of the core opening 2 with respect to the leading end of the wire 6.

Operation of the Coil Winding Apparatus A

Operation of the coil winding apparatus A of the aforesaid construction will now be described by referring to FIGS. 12–20.

Figure 12:
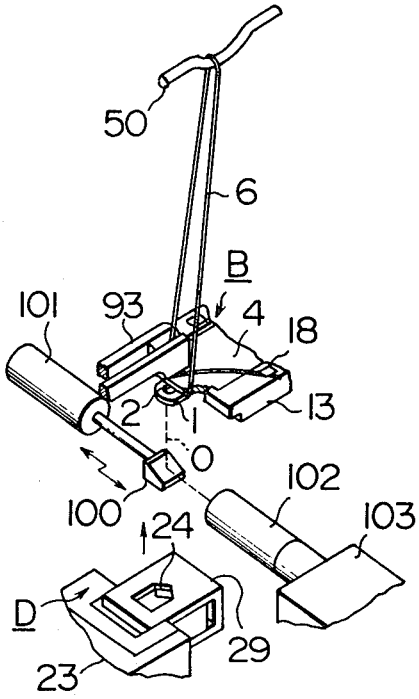
FIGS. 12–20 are perspective views in explanation of the process of winding a wire by the apparatus shown in FIG. 1.

The toroidal core 1 is fixed in a predetermined position with its axis oriented vertically as the core base 4 mounting the toroidal core 1 thereon beforehand is supported by the support means B as shown in FIG. 12.

To perform a first winding operation, the fluidic cylinder 101 of the position sensing means H is actuated to move the reflector 100 to the position in which it is disposed immediately below the other surface or under surface of the core opening, to permit the image of the core opening 2 to be incident on the reflector 100. The image of the core opening 2 is reflected by the reflector 100, enlarged by the microsope 102 and transmitted to the TV camera 103 which converts the optical image to electric signals and transmits the image information to the position correcting circuit I.

The center position 0 of the core opening 2 is calculated based on the image information at the position sensing circuit 104 of the position correcting circuit I, and the calculated center position 0 is supplied to the memory 5 to be stored therein.

Following processing of the image information, the cylinder 101 of the position sensing means H is actuated to move the reflector 100 rearwardly, to return the reflector 100 to its original position.

In forming a first convolution of a coil, end portions of the wire 6 cut in a predetermined length are held in place as presently to be described before or after the position of the core opening 2 is sensed. More specifically, one end portion of the length of wire 6 is passed through the through hole 5 of the core base 4 and inserted between the fixed arms 13 and plate springs 18 of the fixing means C and fixed in position, and the wire 6 is trained over the tensioning rod 50 of the tensioning means E. The other end portion of the wire 6 is gripped by the claw 93 of the gripper G while leaving free a portion of the wire 6 having a predetermined length from the leading end 7 thereof, or the length which is enough to allow the leading end 7 to extend beyond the other surface of the toroidal core 1 when the other end portion of the wire 6 is inserted in the core opening 2 from the side of one surface of the core 1 in the operation presently to be described.

Then the gripper G and transfer means F are actuated to move the gripper G in a direction in which the gripper G is disposed above the one surface or upper surface of the toroidal core 1, and the gripper G is stopped when the leading end 7 of the wire 6 is disposed close to the core opening 2 and in alignment therewith. At this time, the gripper G may be moved to a position in which the leading end 7 of the wire 6 is inserted in the core opening 2 and emerges therefrom to extend beyond the under surface of the core 1.

Figure 13:
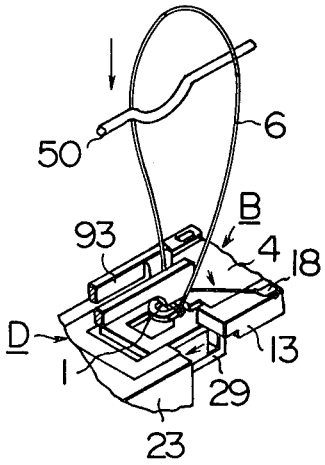
Figure 14:
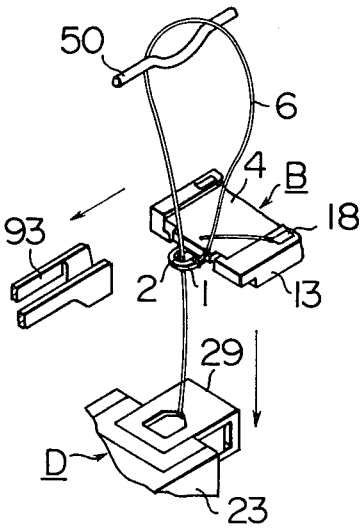

Upon the leading end 7 of the wire 6 being moved to the position in which it is in alignment with the core opening 2, the pull-out means D is moved, as shown in FIG. 13, toward the other surface or under surface of the core 1 and stopped in a position close to the core opening 2. Then the vacuum pump 27 of the pull-out means D is actuated to draw air through the nozzle 24. Also, the claw 93 of the gripper G is brought to an open position to release the wire 6 while moving the tensioning rod 50 of the tensioning means E in a direction in which the wire 6 is loosened. This allows the leading end 7 of the wire 6 to be drawn by suction through the core opening 2 into the nozzle 24 by the operation of the vacuum pump 27 of the pull-out means D. Thereafter the support plate 29 is moved in a direction in which it holds the wire 6, and the vacuum pump 29 is deactuated. As shown in FIG. 14, the claw 93 of the gripper G is moved rearwardly and the pull-out means D is moved in a direction in which it is moved away from the under surface of the core 1 while holding the leading end 7 of the wire 6, to pull a predetermined length of the wire 6 out of the core opening 2.

Figure 15:
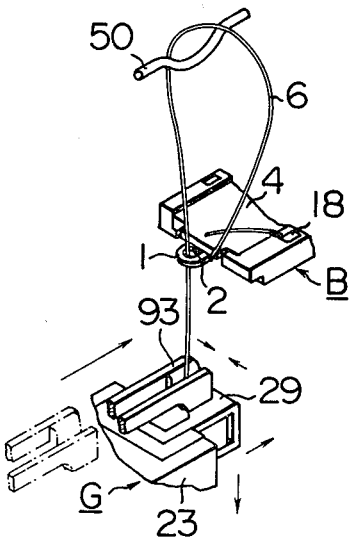

The claw 93 of the gripper G is rotated through the extent of a suitable angle around the toroidal core 1 by the transfer means F, to move to a position in which it can grip the wire 6 pulled out of the core opening 2 beyond the other surface of the core 1. Then, as shown in FIG. 15, the claw 93 is moved forwardly and brought to a closed position to grip the wire 6.

Upon the claw 93 of the gripper G gripping the wire 6, the holding plate 29 of the pull-out means D is actuated and releases the leading end 7 of the wire 6, and the pull-out means D is returned to the original position disposed below.

Figure 16:
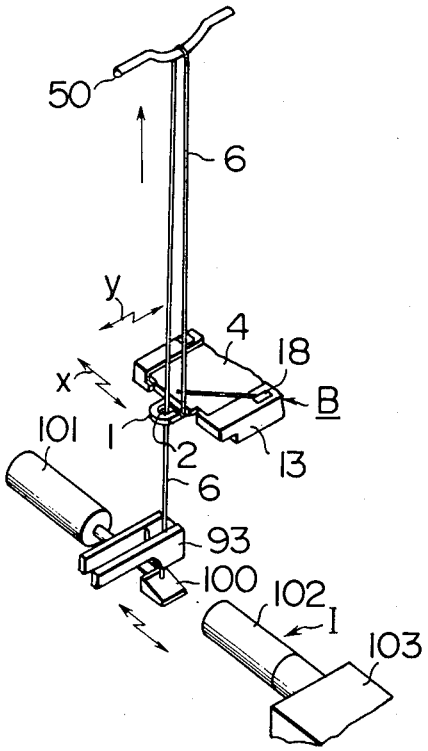

The tensioning rod 50 of the tensioning means E is actuated to impart a predetermined tension to the wire 6 as shown in FIG. 16, to straighten the wire 6.

Following straightening of the wire 6, the fluidic cylinder 101 of the position sensing means H is actuated again to move the reflector 100 forwardly to a position in which it is disposed, as shown in FIG. 16, immediately below the leading end 7 of the wire 6. As a result, the leading end 7 of the wire 6 is incident on the reflector 100 and the position of the leading end 7 of the wire 6 is transmitted to the position sensing circuit 104 of the position correcting circuit I through the TV camera 103.

In the position correcting circuit I, the position of the leading end 7 of the wire 6 and the center position 0 of the core opening 2 already stored in the memory 105 are transmitted, as shown in FIG. 11, to the displacement calculating circuit 106 from the position sensing circuit 104 and the memory 105 respectively, so that the amount of displacement of the position of the leading end 7 of the wire 6 with respect to the center position 0 of the core opening 2 is calculated and transmitted to the stepping motor commanding circuit 107.

The stepping motor commanding circuit 107 supplies position correcting pulses commensurate with the sensed displacements to the first and second stepping motor drivers 108 and 109 on the table J, to actuate the first and second stepping motors 110 and 111 to move the table J in fine movement in the directions of the arrow x and y shown in FIG. 1. As a result, fine adjustments of the position of the toroidal core 1 supported by the support means B can be effected in three dimensions, so that the center position 0 of the core opening 2 can be brought into alignment with the leading end 7 of the wire 6.

Following processing of the information, the fluidic cylinder 101 of the position sensing means H is actuated at an opportune time to return the reflector 100 to the original position in which it does not interfere with other parts.

Figure 17:
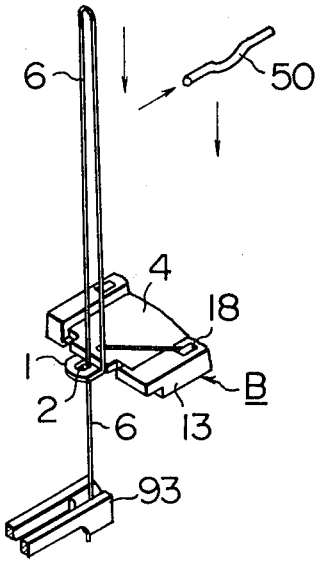
Figure 18:
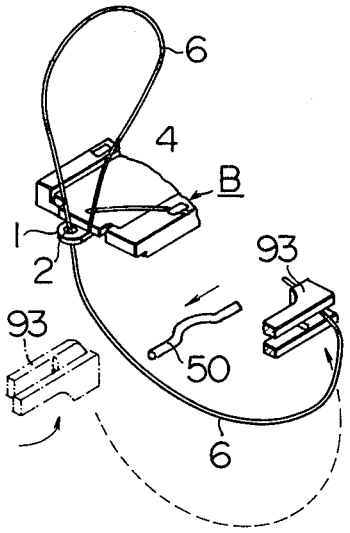

Following completion of aligning of the center position 0 of the core opening 2 with the position of the leading end 7 of the wire 6, the tensioning rod 50 of the tensioning means E is brought out of engagement with the wire 6 as shown in FIG. 17 and moved downwardly to a position in which it is interposed between the toroidal core 1 and claw 93. Then the claw 93 of the gripper G is moved counterclockwise by the transfer means F, as shown in FIG. 18, while rotating counterclockwise on its own axis with the wire 6 being gripped thereby, to transfer the wire 6 along a predetermined path. At the same time, the tensioning rod 50 projects into the path of travel of the wire 6 pulled out of the core opening 2 by the movement of the claw 93.

Figure 19:
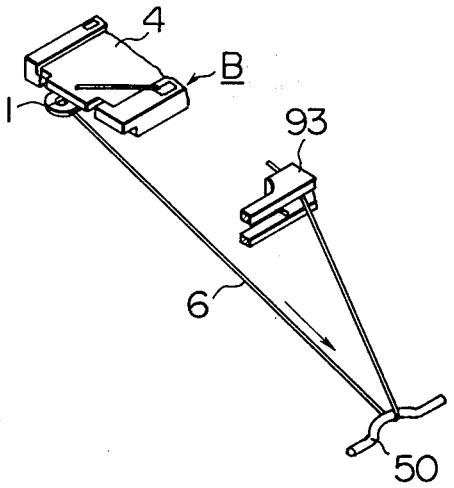

Then the tensioning rod 50 is moved in a direction in which it crosses the arcuate path of movement of the claw 93, so as to impart a predetermined tension to the wire 6 as shown in FIG. 19 after the wire 6 is pulled out of the core opening 2. Since the claw 93 rotates on its own axis as it moves counterclockwise in a semicircle, its bending can be avoided.

Figure 20:
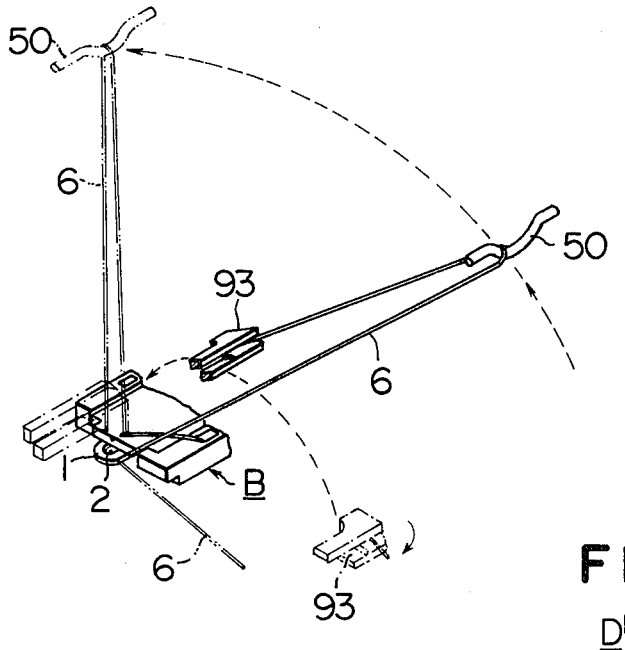
Figure 21:
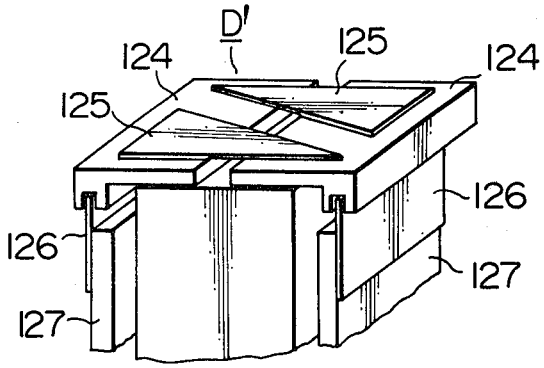
FIG. 21 is a fragmentary perspective view, on an enlarged scale, of a modification of the pull-out means shown in FIG. 6.
Figure 22:
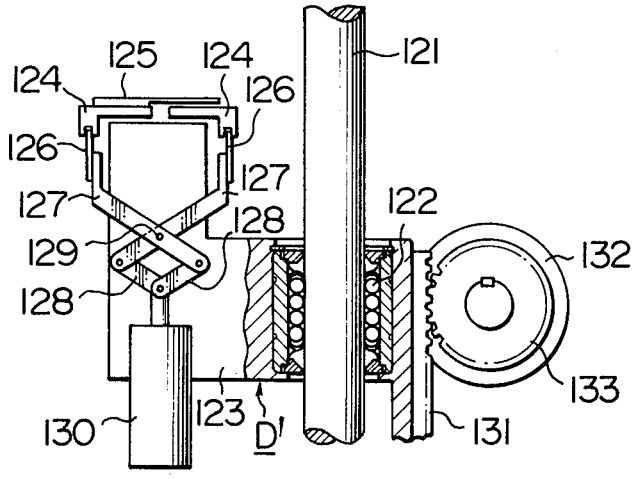
FIG. 22 is a side view, with certain parts being shown in section, of the pull-out means shown in FIG. 21.

Then, as shown in FIG. 20, the claw 93 and tensioning rod 50 are simultaneously moved counterclockwise while keeping the tension of the wire 6 at a predetermined value by the rod 50, and the claw 93 is rotated clockwise on its own axis during the aforesaid movement, so that the claw 93 and tensioning rod 50 are returned to their original positions shown in FIG. 12. The wire is wound around the toroidal core 1 by the claw 93 cooperating with the tensioning rod 50, thereby finishing winding of the wire 6 on the toroidal core 1 to form one convolution.

In performing the second and following convolution forming operations, the leading end 7 of the wire 6 can be automatically brought to a position in which it is in alignment with the center position 0 of the core opening 2, because the core opening 2 is positioned beforehand with its center position 0 in alignment with the leading end 7 of the wire 6.

By repeating the aforesaid operation, it is possible to form coils on the toroidal core in an automatic winding operation.

In the foregoing description, the position sensing means H used for sensing the relative positions of the core opening 2 and the leading end 7 of the wire 6 has been described as being an optical system. It is to be understood, however, that the invention is not limited to this specific form of the position sensing means, and that any other type may be used. Also, the wire pull-out step may be carried out by using any known means in place of relying on the pull-out means D of the vacuum type described.

When a wire has been wound on a toroidal core 1, the core opening 2 becomes smaller in size. Thus the size of the core opening 2 may be measured each time a wire has been wound on the toroidal core 1 and the center position 0 thereof may be calculated, so as to match the center position of the actual opening 2 of the core 1 with the leading end 7 of the wire 6 each time the winding of a wire is performed. Also, when the size of the core opening 2 is sufficiently large or the position of the core opening 2 is sufficiently high in accuracy, the position of the leading end 7 of the wire 6 alone may be measured in bringing the core opening 2 into alignment with the leading end 7 of the wire 6.

Also, when the gripper G gripping the wire 6 is stopped in a predetermined position above the surface of the core opening 2 in forming a first convolution, the core opening 2 and the leading end 7 of the wire 6 may be simultaneously sensed by the position sensing means H, and the displacement of their positions may be calculated by the position correcting circuit I. Then they may be moved relative to each other to correct their positions, so as to bring their positions in alignment with each other from the first wire winding operation.

Modification of the Pull-out Means

Figure 23:
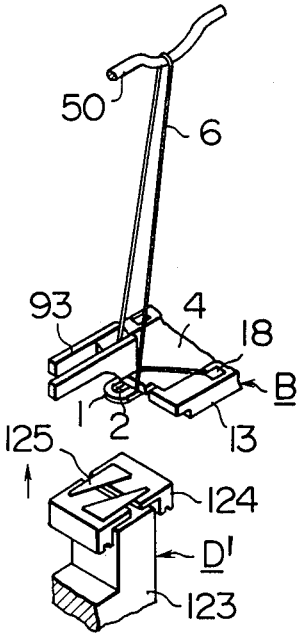
FIGS. 23 and 24 are perspective views in explanation of the operation of the pull-out means shown in FIG. 21.

FIGS. 21, 22, 23 and 24 show a modification of the pull-out means. The pull-out means D' comprises a guide rod 121, a chuck body 123 slidably supported by the guide rod 121 through a ball bush 122, a pair of chucks 124 disposed in spaced juxtaposed relation in a plane in the chuck body 123 facing a toroidal core, a pair of guide plates 125 of the triangular shape positioned against each other on the surfaces of the chucks 124, a fluidic cylinder 130 for operating a linkage for opening and closing the chucks 124, a rack 131 attached to one end of the chuck body 123, a stepping motor 132 for moving the chuck body 123, and a pinion 133 mounted on the rotary shaft of the stepping motor 132 and meshing with the rack 131. The linkage for opening and closing the chucks 124 comprises two first links 128 connected through pins to the piston rod of the fluidic cylinder 130, two second links 127 each connected to one of the first pins 128 through a pin and interconnected at their intermediate portions by a pin 129 at which the two links 127 cross each other, and two plate springs 126 each secured to an end of one of the second links 127 and having a forward end portion inserted in a groove formed at an end portion of one of the chucks 124. In operation, the gripper G is moved, prior to the operation of the pull-out means D', to a position close to the upper surface of the toroidal core 1 to ensure that the leading end 7 of the wire 6 gripped thereby is passed through the core opening 2 and extend beyond the under surface of the core 1. Then the stepping motor 132 is rotated in the normal direction to move the pull-out means D' through the rack 133 and pinion 131 toward the under surface of the toroidal core 1, as shown in FIG. 23. At this time, the chucks 124 remain in an open position. As the chucks 124 get near the under surface of the core 1 and the leading end 7 of the wire 6 projecting from the under surface of the core 1 is inserted between the chucks 124 in the open position, the pull-out means D' stops moving. Then the fluidic cylinder 130 is actuated to bring the chucks 124 to a closed position through the linkage. Thus the leading end 7 of the wire 6 is gripped by the chucks 124 after being guided by the guide plates 125, also moving to a closed position, to move to the central position in the gap between the chucks 124 as seen lengthwise thereof.

Figure 24:
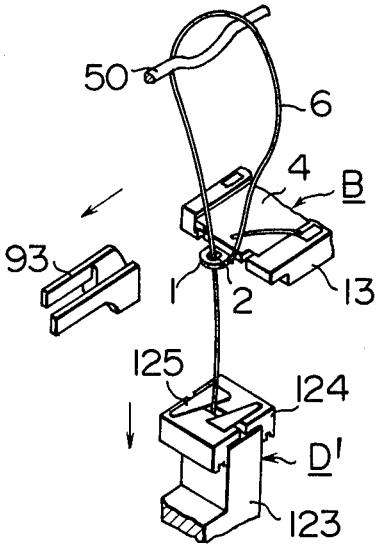

Following gripping of the leading end 7 of the wire 6 by the chucks 124, the stepping motor 132 is rotated in the reverse direction to move the chuck body 123 through the rack 133 and pinion 131 in a direction in which it moves away from the toroidal core 1 as shown in FIG. 24, to thereby pull the wire 6 out of the core opening 2.

Then the wire 6 pulled out of the core opening 2 is gripped by the claw 93 of the gripper G, and the fluidic cylinder 130 is actuated to bring the chucks 124 to the open position through the linkage, to release the wire 6. After the wire 6 is thus released, the chuck body 123 further moves in the direction in which it is moved away from the toroidal core 1, to be restored to its original position.

It will be seen that the method of the invention can be carried into practice by using the pull-out means D' with the same effects.

Another Embodiment of the Coil Winding Apparatus

FIGS. 25–30 show another embodiment of the coil winding apparatus in conformity with the invention. In FIGS. 25–30, parts similar to those shown in FIGS. 1–24 are designated by like reference characters. Thus the coil winding apparatus A' comprises the support means B, fixing means C, pull-out means D, tensioning means E, transfer means F and gripper G of the same construction as those of the coil winding apparatus A, but it does not comprise the position sensing means H, position correcting circuit I and table J of the coil winding apparatus A.

Figure 25:
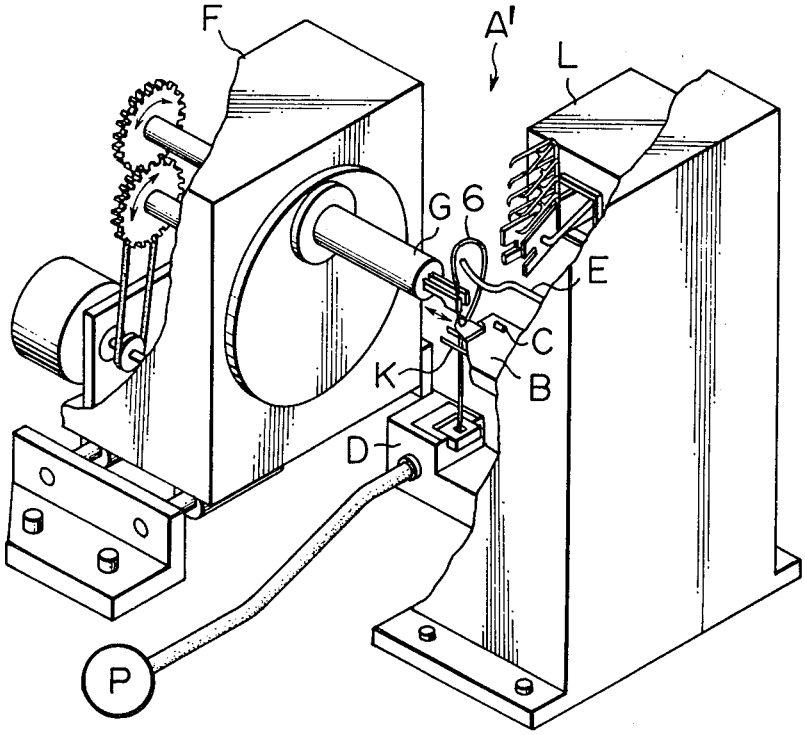
FIG. 25 is a perspective view of the coil winding apparatus comprising another embodiment.

Referring to FIG. 25, the coil winding apparatus A' additionally comprises lower guide means K holding the wire 6 for regulating the path of movement of the wire 6 that has been pulled out of the core opening 2 by the pull-out means D beyond the under surface of the core 1, and upper guide means L holding the wire 6 for regulating the path of movement of the wire 6 that has been transferred by the transfer means F and gripper G to a position above the upper surface of the core opening 2.

Lower Guide Means K

Figure 26:
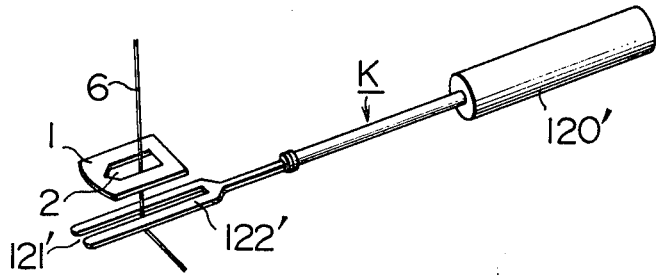
FIG. 26 is a perspective view of the lower guide means of the apparatus shown in FIG. 25.
Figure 27:
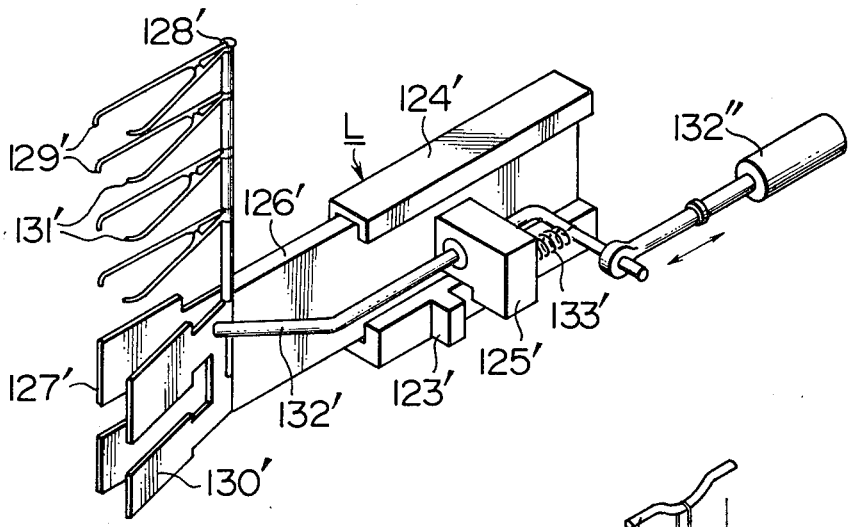
FIG. 27 is a perspective view of the upper guide means of the apparatus shown in FIG. 25.

Referring to FIG. 26, the lower guide means K comprises a cylinder 120' secured to a machine frame, and a guide plate 122' secured to one end of the rod of the cylinder 120' and formed with a U-shaped portion at its forward end defining a slit 121'. As the wire 6 is pulled out of the core opening 2, the lower guide means K moves forwardly so that the slit 121' receives therein the wire 6 for regulating the path of movement thereof.

Upper Guide Means L

The upper guide means L comprises, as shown in FIG. 26, a slider 126' formed with a projection 125' slidably supported by a rail 124' formed with a stopper 123' for engaging the stopper 125', a guide plate 127' secured to one end of the slider 126', a plurality of guide claws 129' secured to a rod 128' which in turn is secured to the slider 126', a guide plate 130' pivotally supported by the rod 128' and disposed in side-by-side relation to the guide plate 127' for movement in which its forward end portion is moved away from and toward the guide plate 127', a plurality of guide claws 131' formed integrally with the guide plate 130' and positioned against the guide claws 129', a rod 132' secured at one end thereof to the rod of a cylinder 132'' and slidably penetrating the projection 125' of the slider 126' and positioned at the other end thereof against the guide plate 130' to press the guide plate 130' and move it in pivotal movement, and a spring 133' mounted between the rod 132' and the projection 125'.

In operation, actuation of the cylinder 132'' to move its rod forwardly moves the slider 126' forwardly until the projection 125' abuts against the stopper 123' and moves the guide plates 127' and 130' and the guide claws 129' and 131' upwardly above the toroidal core 1, to bring them into alignment with the wire 6 that has been moved by the tensioning means E to a position above the core opening 2. Further forward movement of the rod of the fluidic cylinder 132'' causes the rod 132' to move forwardly by compressing the spring 133', thereby moving the guide plate 130' in pivotal movement to hold the wire 6 between the guide plates 127' and 130'. At this time, the guide claws 131' also move in pivotal movement to hold the wire between the guide claws 129' and 131'. Rearward movement of the cylinder 132'' causes the rod 1 to be moved rearwardly by the biasing force of the spring 133' and moves the guide plates 130' and guide claws 131' rearwardly in pivotal movement into open positions. Thereafter the slider 126' is moved rearwardly.

Operation of the Coil Winding Apparatus A'

Figure 28:
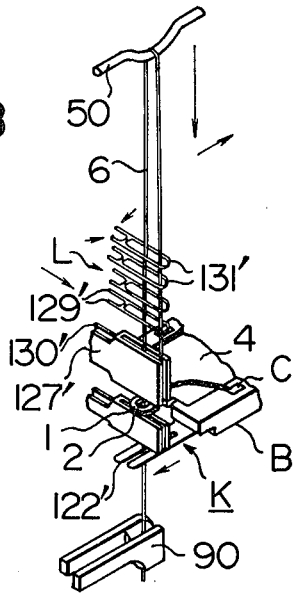
FIGS. 28–30 are perspective views in explanation of the operation of the upper guide means and the lower guide means.

Operation of the coil winding apparatus A' of the aforesaid construction will now be described. As in the first embodiment, the wire 6 is cut in a predetermined length and fixed at one end thereof by the fixing means C while having its leading end portion gripped by the claw 93 of the gripper G of the transfer means H after passing through the core opening 2. By moving the wire 6 upwardly by the tensioning rod 50 of the tensioning means E, the leading end of the wire 6 is brought into alignment with the core opening 2, and then air is drawn by suction by the pull-out means D from below the core 1. At the same time, the wire 6 is loosened and the claw 93 is opened to allow the leading end of the wire 6 to pass through the core opening 2 to be gripped by the pull-out means D. Thereafter the pull-out means D is moved downwardly to pull the wire 6 out of the core opening 2 beyond the under surface of the core 1 and allow the claw 93 to grip the leading end portion of the wire 6 again. The wire 6 gripped by the gripper G is tensioned by the action of the tensioning rod 50, and the cylinder 132'' of the upper guide means L is actuated to move the guide plates 127' and 130' and guide claws 129' and 131' forwardly and hold the wire 6 therebetween as shown in FIG. 28. At the same time, the guide plate 122' of the lower guide means K is moved forwardly to allow the wire 6 to be received in the slit 121'.

Figure 29:
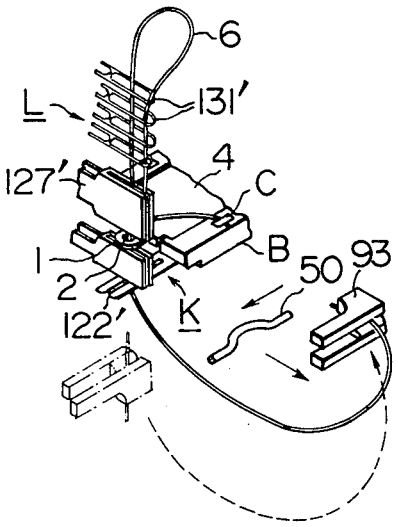
Figure 30:
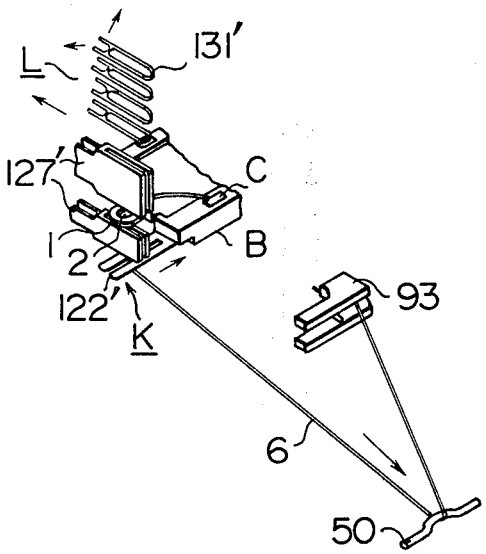

Then the tensioning rod 50 is moved downwardly and rearwardly to thereby loosen the wire 6, and the claw 93 is rotated while pulling out the wire 6 as shown in FIGS. 29 and 30 in the same manner as shown in FIGS. 18 and 19 with reference to the first embodiment of the coil winding apparatus A. At the same time, the tensioning rod 50 is moved into the path of movement of the wire 6, and then caused to cross the path of movement of the claw 93, so as to pull the wire 6 completely out of the core opening 2 and tension the wire 6. At this time, the wire 6 being pulled out of the core opening 2 is guided by the guide plates 127' and 130' and the guide claws 129' and 131' above the toroidal core 1, to thereby avoid the production of a kink which might otherwise be caused by bending of the wire 6 of low rigidity and prevent the wire from rubbing against the upper edge of inner surface of the core 1 defining the core openings 2. Below the toroidal core 1, the wire is guided by the slit 121' of the guide plate 122' to thereby prevent the wire 6 from rubbing against the upper edge of the inner surface of the core 1. Thus the wire 6 can be pulled out of the core opening 2 without suffering any damage.

The guide plate 130' and guide claws 131' are then pivotally moved out of engagement with the guide plate 127' and guide claws 129' respectively and moved rearwardly. Thereafter, the wire 6 is moved upwardly to a position above the toroidal core 1 in the same manner as shown in FIG. 20 by referring to the coil winding apparatus A.

The upper guide means L is constructed such that the wire 6 is held thereby with a small clearance between the wire 6 and guide means L, to allow the wire 6 to move smoothly.

Modification of the Support Means

Figure 31:
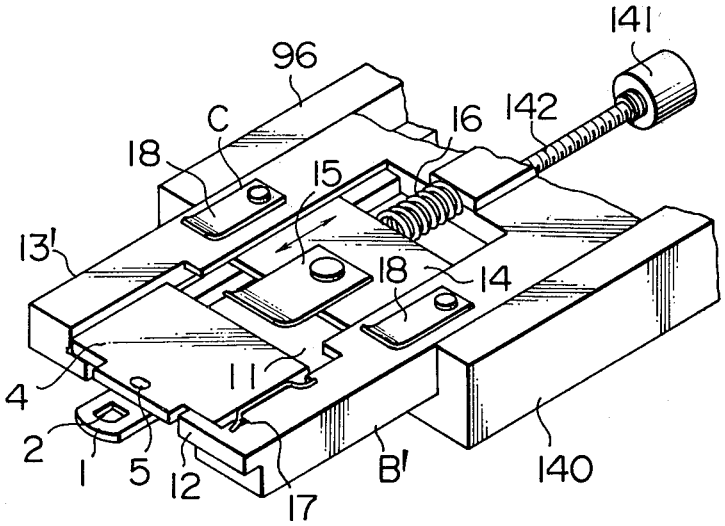
FIG. 31 is perspective view of a modification of the support means shown in FIG. 5.

FIG. 31 shows a modification of the support means having particular utility in the coil winding apparatus A'.

As shown, the support means B' comprises movable arms 13' slidably supported by a pair of rails 140 and having a nut, not shown, mounted on its underside, a stepping motor 141, and a feed screw 142 connected at one end thereof to the stepping motor 141 and threadably connected to the nut at the other end thereof for moving the movable arms 13' in sliding movement along the rails 140 upon rotation of the stepping motor 141. Other parts of the support means B' are similar to the corresponding parts of the support means B and designated by like reference characters used in FIG. 5.

In operation, the stepping motor 141 is rotated upon forming each convolution of a coil, to move the movable arms 13' and hence the toroidal core 1 a distance corresponding to the diameter of the wire 6. Thus the wire 6 can be wound in regular order on the toroidal core. By using the support means B' in the coil winding apparatus A' shown in FIG. 25 comprising the upper guide means L and lower guide means K, it is possible to achieve more uniform winding of the convolutions of a coil in regular order.

When the support means B' is used, the center position of the core opening 2 is moved widthwise of the wire 6 each time a convolution is formed. Therefore, when the support means B' is used with the coil winding apparatus A shown in FIG. 1 comprising the position sensing means H, position correcting circuit I and table J, calculation of the center position of the core opening 2 in the position sensing circuit 104 of the position correcting circuit I is preferably carried out by determining the widthwise center position of the core opening 2 and comparing the result with the position of the leading end 7 of the wire 6. Alternatively, when the leading end 7 of the wire 6 is inserted in the core opening 2 after the position of the wire 6 is corrected by the means H, I and J, the toroidal core 1 may be returned to its initial position at all times and moved by the support means B' a distance as required after the leading end 7 is inserted in the core opening 2 in the condition shown in FIG. 16.

What is claimed is:

1. An apparatus for winding a wire around a toroidal core formed with a center opening and having two opposite surfaces, the wire being of a predetermined length and having opposite end portions, comprising:

(a) support means for supporting said toroidal core;
(b) fixing means for fixing one end portion of said wire;
(c) gripper means for releasably gripping the other end portion of said wire;
(d) transfer means for moving said gripper means along a predetermined path;
(e) said transfer means including means for locating said gripper means in a first position where an extremity of the other end portion of the wire gripped by said gripper means is substantially in alignment with the opening of the core above one of said opposite surfaces of the toroidal core;
(f) pull-out means for gripping the other end portion of said wire beneath the other of said surfaces of the toroidal core and for partially pulling the wire axially from the opening;
(g) said transfer means further including means for moving said gripper means to a second position beneath said other surface of the core and from said second position to said first position after completion of a partial pull-out of the wire by said pull-out means; and
(h) tensioning means for imparting a tension to the wire while said gripper means is moved from said second position to said first position, for fully pulling out the partially pulled-out wire and for keeping a substantial portion of the fully pulled-out wire straightened in cooperation with said gripper means, whereby the wire is wound around the core without causing a bending of the wire of the type which might produce a kink.

2. An apparatus as claimed in claim 1, wherein said pull-out means comprises suction means.

3. An apparatus as claimed in claim 1, wherein said pull-out means comprises chuck means for gripping the leading end of the wire, and guide means for guiding the leading end of the wire from the center openingof the core toward the center of said chuck means.

4. An apparatus as claimed in claim 1, further comprising position sensing means for optically sensing the center position of the opening of the toroidal core and the position of the extremity of the other end portion of the wire gripped by said gripper means on a side of one of the opposite surfaces of the toroidal core, position correcting circuit means including means for calculating the center position of the opening of the toroidal core and the position of the extremity of the other end portion of the wire, based on information supplied by said position sensing means, and means for calculating the value of a deviation between the center position of the opening and the position of said extremity for issuing a position correcting signal, and means for relatively moving said support means and said gripper means based on the position correcting signal, thereby to bring the extremity of the other end portion of the wire into correct alignment with the center position of the opening of the toroidal core.

5. An apparatus as claimed in claim 4, wherein said position sensing means comprises a reflector, a microscope for enlarging the image reflected by said reflector, and a television camera for converting the optical images from said microscope into electric signals and for transmitting the image information to said position correcting circuit means.

6. An apparatus as claimed in claim 1, further comprising first guide means located, on a side of said core from which the wire exits therefrom, and mounted for sliding movement in a direction traversing the portion of the wire pulled out of the opening of the toroidal core by said pull-out means, for holding the wire so as to regulate the path of movement thereof, and second guide means located, on a side of said core into which said wire enters said opening, and mounted for sliding movement in a direction traversing the portion of the wire yet to be pulled out of the opening of the toroidal core by said pull-out means, for holding the wire to regulate the path of movement thereof.

7. An apparatus as claimed in claim 1 or 6, wherein said support means comprise means for moving said toroidal core in a direction traversely of an insertion direction of the wire into the core opening for enabling the core to be shifted a distance corresponding to the diameter of the wire upon forming each convolution of a coil upon said core.

8. An apparatus as claimed in claim 1, wherein said tensioning means comprises a tensioning rod for engaging the wire, and means for moving the tensioning rod simultaneously with said gripper means while keeping said tension applied to the wire.

9. An apparatus as claimed in claim 1, further comprising means for optically sensing at least the position of the extremity of the other end portion of the wire gripped by said gripper means and for producing a position correcting signal when the position of the extremity deviates from a reference position, and means for relatively moving said support means and said gripper means based on the position correcting signal, thereby to bring the extremity of the other end portion of the wire into correct alignment with the center position of the opening of the toroidal core.

10. An apparatus for winding a wire around a toroidal core formed with a center opening and having two opposite surfaces, the wire being of a predetermined length and having opposite end portions, comprising:

(a) support means for supporting said toroidal core;
(b) fixing means for fixing one end portion of said wire;
(c) gripper means for releasably gripping the other end portion of said wire;
(d) transfer means for moving said gripper means between first and second positions along a predetermined path;
(e) said transfer means including means for locating said gripper means in first position where an extremity of the other end portion of the wire gripped by said gripper means is substantially in alignment with the opening of the core above one of said opposite surfaces of the toroidal core;
(f) pull-out means for gripping the other end portion of said wire beneath the other of said surfaces of the toroidal core and for at least partially pulling the wire axially from the opening;
(g) said transfer means further including means for moving said gripper means from the second position beneath said other surface of the core to said first position after the wire is completely pulled out of the opening of the core;
(h) tensioning means for imparting a tension to the wire to straighten a substantial portion of the wire to prevent occurrence of an undesired bending of the wire of the type which might produce a kink;

(i) means for optically sensing at least the position of the extremity of the other end portion of the wire gripped by said gripper means and for producing a position correcting signal when the position of the extremity deviates from a reference position; and (j) means for relatively moving said support means and said gripper means based on the position correcting signal, thereby to bring the extremity of the other end portion of the wire into correct alignment with the center position of the opening of the toroidal core.

11. An apparatus as claimed in claim 10, wherein said means (i) comprises position sensing means for optically sensing the center position of the opening of the toroidal core and the position of the extremity of the other end portion of the wire gripped by said gripper means, and position correcting circuit means including means for calculating the center position of the opening of the toroidal core and the position of the extremity of the other end portion of the wire based on the information supplied by said position sensing means and means for calculating the value of a deviation of the extremeity of the wire from the center position of the core to produce said position correcting signal.

12. An apparatus as claimed in claim 1 or 10, wherein said tensioning means comprises a tensioning member and means for moving said tensioning member in directions toward and away from said core for applying a predetermined tension to the wire, and means for moving said tensioning member about said core simultaneously in coordination with movement of said gripper means from a point intermediate its second and first positions to said first position for maintaining the wire in a straightened condition as it is wound about said core by said gripper.

* * * * *